United States Patent [19]

Frezzotti

[11] 4,162,936

[45] Jul. 31, 1979

[54] WASHING DEVICE FOR IMPERMEABLE AREAS OF CYLINDER MOLDS

[75] Inventor: Armando Frezzotti, Fabriano, Italy

[73] Assignee: Fibrostampa S.R.L., Milan, Italy

[21] Appl. No.: 861,633

[22] Filed: Dec. 19, 1977

[30] Foreign Application Priority Data

Dec. 23, 1976 [IT] Italy ..... 9713 A/76

[51] Int. Cl.[2] ..... D21F 1/32; D21F 1/44

[52] U.S. Cl. ..... 162/276; 162/304; 162/306; 162/307; 162/334

[58] Field of Search ..... 162/276, 279, 296, 304, 162/306, 307, 322, 334, 335, 357, 116, 133, 211, 217

[56] References Cited

U.S. PATENT DOCUMENTS

| | | | |
|---|---|---|---|
| 1,771,355 | 7/1930 | Scofield | 162/276 |
| 2,396,694 | 3/1946 | Goodwillie et al. | 162/335 X |
| 3,695,996 | 10/1972 | Frezzotti | 162/357 X |

*Primary Examiner*—Richard V. Fisher
*Attorney, Agent, or Firm*—J. Harold Nissen

[57] ABSTRACT

A continuous machine for the manufacture of fiber-containing materials such as paper, which comprises a rotating cylinder partly immersed in a body of liquid containing fibers in suspension. The surface of the cylinder comprises permeable and impermeable areas arranged in a predetermined pattern, and fibers are drawn onto the permeable areas by suction from within the cylinder, the layers of fibers formed on these areas being transferred to a conveyor belt which contacts the cylinder surface at a zone out of contact with the liquid. The surface of the cylinder is washed upstream of the transfer zone to remove fibers and other particles which may adhere to the impermeable areas of the cylinder surface by feeding cleansing liquid, such as pure water, across an overflow edge into a space adjacent the cylinder so that the cleansing liquid flows parallel to the impermeable areas.

10 Claims, 3 Drawing Figures

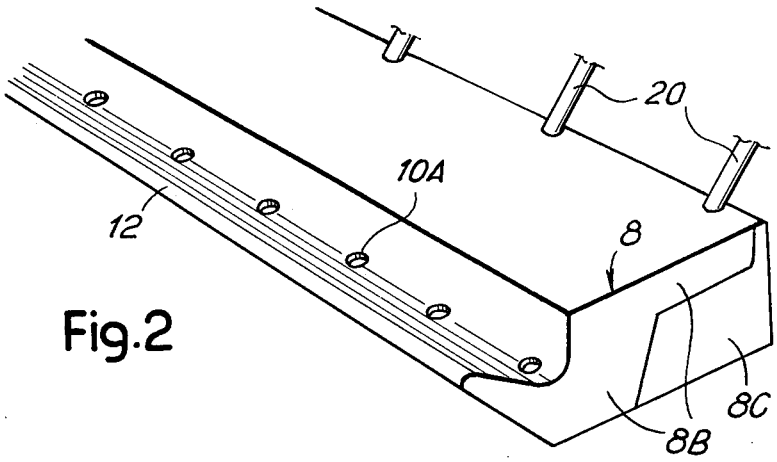
Fig.2
Fig.3
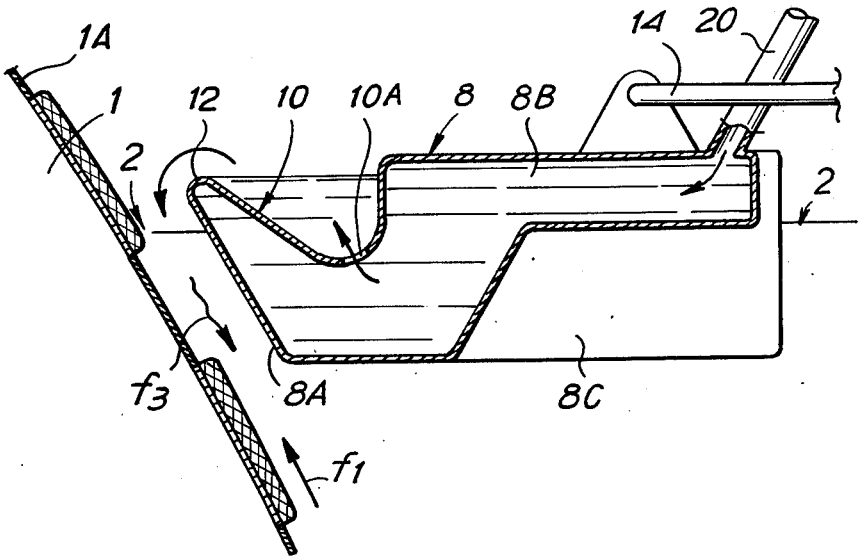

WASHING DEVICE FOR IMPERMEABLE AREAS OF CYLINDER MOLDS

BACKGROUND OF THE INVENTION

1. Field of the Invention

The present invention relates to a continuous machine for the manufacture of paper, paperboard, non-woven fabrics and other fiber-containing materials.

2. Description of the Prior Art

There has been proposed in Italian Patent No. 856,072, German Patent No. 2,006,971, British Patent No. 1,257,453, French Patent No. 7,005,599, and U.S. Pat. No. 3,695,996, a continuous machine for the manufacture of paper and other fiber-containing materials comprising a rotating cylinder the outer surface of which is defined by a metal gauze, parts of which are rendered impermeable or waterproof. The cylinder is partly immersed in a body of liquid containing fibers in suspenion. Fibers are drawn by suction onto those areas of the gauze which remain permeable and these fibers form layers which are to act as watermarks in the finished paper. The layers are transferred from the cylinder onto a conveyor belt, the transferred layers of fibers being directly deposited onto the surface of the belt or onto a layer of fibers previously formed on the belt.

In this previously proposed machine some fibers tend to adhere to the non-permeable areas of the cylinder surface and a requirement exists for a machine of this type in which this effect is obviated.

SUMMARY OF THE INVENTION

According to the present invention, there is provided in a continuous machine for the manufacture of fiber-containing material, for example paper, a rotatable cylinder partly immersed in a body of liquid containing fibers in suspension, said cylinder having a surface composed of permeable areas and impermeable areas, means in the interior of the cylinder for applying a suction through the permeable areas so as to draw fibers onto the permeable areas of said surface to form layers thereon, means defining a conveyor belt engaging the exposed portion of the cylinder whereby the fiber layers are transferred from said permeable areas of the cylinder to the conveyor belt, a structure located adjacent that portion of the cylinder surface which emerges from the liquid during rotation of the cylinder, said structure having an overflow edge spaced from the cylinder surface, means for feeding a cleansing liquid to flow across the overflow edge into the space between the structure and the cylinder surface to remove fibers from the impermeable areas, and means for facilitating detachment of the layers of fibers from the permeable areas.

Further according to the present invention, there is provided in a machine for the manufacture of fiber-containing materials, for example paper, a rotating cylinder partly immersed in a body of liquid containing fibers in suspension, the cylinder having a circumferential surface defined by permeable areas and impermeable areas arranged in a predetermined pattern, means for applying a suction to the permeable areas from within the cylinder so that fibers are drawn onto said permeable areas during rotation of the cylinder in the liquid, conveyor belt means adjacent a portion of the cylinder out of contact with the liquid, means enabling transfer of the fibers from said permeable layers to the conveyor belt means, and means for washing the impermeable areas of the cylinder surface upstream of the said portion of the cylinder by feeding water across an overflow edge into a space adjacent the cylinder whereby to remove fibers from said impermeable areas by flowing water parallel thereto.

BRIEF DESCRIPTION OF THE DRAWINGS

An embodiment of the invention will now be described, by way of example only, with reference to the accompanying diagrammatic drawings, in which:

FIG. 1 is a fragementary longitudinal section of a continuous machine for manufacturing paper and the like;

FIG. 2 is a perspective view showing means for washing the cylinder of the machine; and FIG. 3 is a section showing the washing means.

DESCRIPTION OF THE PREFERRED EMBODIMENT

Figure 1:
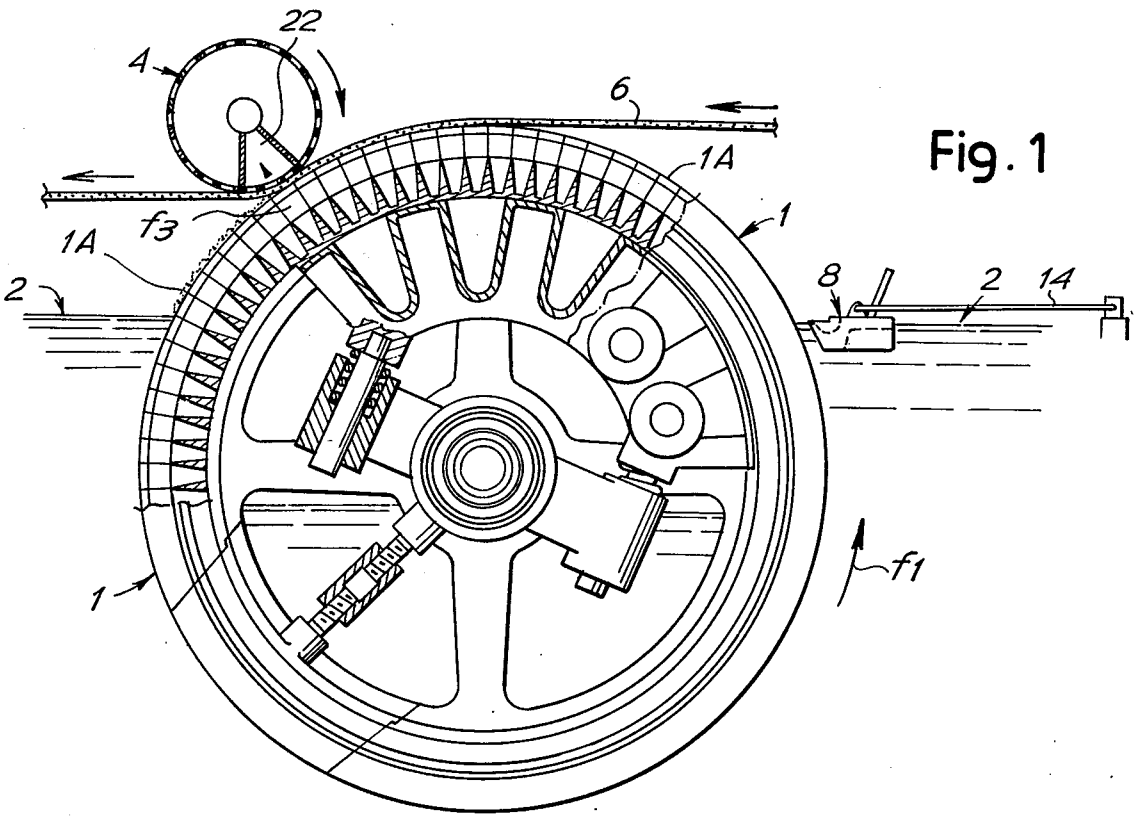

In the drawings 1 denotes a rotating suction and blowing cylinder the outer surface 1A which is defined by a metal gauze parts of which are rendered impermeable, i.e. waterproof, by a varnish or other suitable coating according to a predetermined pattern or design, in the same manner as that of a screen used in silk-screen printing. The cylinder is partly immersed in a body of liquid 2 contained in a tank, the liquid 2 having fibers in suspension. Inside the cylinder 1 there is a stationary structure which forms suction chambers and pressure chambers 24 adapted to exert a sucking action and a blowing action, respectively, on layers of fibers deposited on the permeable areas of the metal gauze. This arrangement corresponds to that described in the aforesaid patent specifications.

A pressing or "couching" roll 4 acts to deflect a continuous collecting belt 6 into engagement with the upper surface of the cylinder 1 over a relatively small arc in order to withdraw the layers of fibers formed on the outer surface 1A of the cylinder, there being a discontinuity in the wall allowing the passage of the metal gauze on the surface 1A of the cylinder. The belt 6 may be composed of felt with a continuous layer of material for making paper which was previously deposited on the continuous layer of material and to which the layers of the fibers on the surface of the cylinder are to be added; alternatively, the layers of fibers on the surface 1A may be transferred directly to the surface of the conveyor belt.

The machine in accordance with the preferred embodiment of the invention provides improved definition of the pattern of fibers transferred from the surface of the cylinder 1 to form a pattern-like watermark, or a pattern or design, on the conveyor belt 6, or on the layer of paper material already formed on the belt. To achieve these improved results it is necessary to ensure on the one hand complete cleaning of the impermeable surfaces of the metal gauze forming the outer surface 1A of the cylinder 1 and, on the other hand, to ensure the smooth transfer to the conveyor belt 6 of the layers of fibers formed on the permeable areas.

For this purpose, provision is made for washing the impermeable areas of the metal gauze forming the surface 1A of the cylinder 1. As shown in FIG. 1, the clylinder 1 rotates in the direction of arrow $f_1$; and, a structure 8 is provided adjacent the surface of the liquid at the side of the cylinder 1 which is moving upwardly out of the liquid. The structure 8 is shaped to form a gutter or channel 10 with an overflow edge 12, which is parallel to, and at a small distance from, the cylinder surface at the zone in which the cylinder emerges from the liquid. Means are provided for supplying a flow of pure water (i.e. water free from particles in suspension) to the channel 10, with a suitable distribution along the overflow edge 12 and at such a flow rate as to ensure that a film of water flows across the edge 12 into the space between the surface 1A and the opposite surface 8A of the structure 8 in the direction of arrow $f_3$ to wash the surface 1A of the cylinder 1. This flow is sufficiently weak to avoid the removal of fibers deposited on the permeable areas of the metal gauze defining the surface 1A and held thereon by the suction inside cylinder 1, but the flow is sufficient to clean the impermeable areas of the metal gauze from small particles or fibers of the suspension which may accidentally adhere thereto. The flow of pure water does not significantly dilute the suspension, although such dilution as it does cause can readily be corrected.

The structure 8 should preferably be in a substantially constant position with respect to the cylinder 1 and to the surface of the liquid. For this purpose, the structure 8 floats on the liquid, but it is held or stablized by a linkage comprising connecting rods 14 (see FIG. 1), which allow the structure 8 to follow variations in the level of the liquid without, in essence, modifying the relative position of structure 8 with respect to the cylinder 1 until the variations in the liquid level are kept, as is usually the case, within restricted limits.

The structure 8 comprises a portion 8C which provides the necessary buoyancy, and an internal chamber 8B which is connected by a series of flexible hoses or pipes 20 to a source of pure water. The water passes from the chamber 8B into the channel 10 through holes 10A in the bottom of the channel 10 to provide the overflow discharge along the whole length of the edge 12, at a readily adjustable speed and flow rate. To ensure a uniform supply to the channel 10, the holes 10A are distributed along the length of the channel 10 and thus along the length of the overflow edge 12. The water supply can be effected by means of a plurality of small pipes distributed along the length of the channel and thus along the length of the chamber 8B, to ensure the above mentioned uniformity.

In order to facilitate the removal of the discontinuous layers of material formed on the permeable areas of the gauze defining the outer surface 1A of cylinder 1, and also to ensure that the layer of material on the belt does not adhere to the impermeable areas of the gauze, a sucking action is provided through a surface of the pressing roll 4 and this acts in conjunction with a blowing action in the direction of arrow $f_2$ of FIG. 1, which is provided as is described in the aforesaid patent specifications, from the pressure chamber 24 in the interior of the cylinder 1. To provide the sucking action there is located inside the pressing roll 4 a stationary structure defining a suction chamber in a sector denoted by 22 in FIG. 1 and corresponding to the area in which the material on the permeable areas of the gauze is to be transferred to the conveyor belt 6.

This arrangement ensures that the continuous layer of material carried by the belt 6 does not adhere to the impermeable areas of the gauze, and facilitates without deformation, the detachment of the discontinuous areas of material which are formed on the gauze in cooperation with the centrifugal thrust (if this latter exists).

Advantageously, for good results both the cylinder 1 and roll 4 are rotated with peripheral speeds which are the same as the speed of the belt 6, and it is also possible to vary as desired the pressure of the roll 4 on the belt 6 and thus on the cylinder 1.

There are thus obtained sharply-defined areas of fibers on the layer carried by the belt 6, these areas being formed by the fiber layers transferred from the gauze on the cylinder; there are however, no residues in the areas where these layers are not to be deposited. On the other hand, the pattern or design obtained by these layers and forming a watermark with over-thicknesses, is uniform owing to the reliability in the detachment of the layers from the gauze and the transfer onto the layer of material formed on the belt 6.

After passing across the cylinder 1, the belt 6 can receive a further continuous layer so that the discontinuous areas of fibers transferred from the cylinder 1 are interposed between two continuous layers and thus represent a watermark with ever-thicknesses, and which may also be chromatically distinctive. The discontinuous areas of the cylinder 1 can be themselves watermarked, as well as the continuous layer or layers, both in the portions corresponding to the areas of fibers formed by the cylinder and in the other portions.

What is claimed is:

1. In a continuous machine for the manufacture of fiber-containing materials, a rotatable cylinder partly immersed in a body of liquid containing fibers in suspension within a tank, said cylinder having a surface composed of permeable areas and impermeable areas, means in the interior of the cylinder for applying a suction through the permeable areas so as to draw fibers onto the permeable areas of said surface to form layers thereon, first means for facilitating detachment of the layers of fibers from said permeable areas, second means defining a conveyor belt engaging the exposed portion of the rotatable cylinder and cooperating with said first means whereby the fiber layers are transferred from said permeable areas of the cylinder to the conveyor belt, a structure located adjacent that portion of the cylinder surface which emerges from the liquid during rotation of the cylinder, said structure having an overflow edge spaced from the cylinder surface, and means for feeding a cleansing liquid to flow across the overflow edge into the space between the structure and the cylinder surface to remove fibers from the impermeable areas

2. A machine according to claim 1, wherein the structure is a floating structure which floats in the body of the liquid, and means are provided to stabilize the position of the structure with respect to the rotatable cylinder.

3. A machine according to claim 1, wherein the structure comprises a channel having a side which defines said overflow edge, and the cleansing liquid is fed to the channel at a plurality of zones along its length whereby to provide a substantially uniform flow of the cleansing liquid across the edge.

4. A machine according to claim 1, wherein said second means comprises suction means arranged to act through the conveyor belt to facilitate detachment of the layers of fibers from the permeable means.

5. A machine according to claim 4, wherein the suction means comprises a rotary roll engageable with the conveyor belt and a stationary suction chamber located within the rotary roll.

6. A machine according to claim 5, wherein said first means comprises means defining a pressure chamber inside the cylinder to generate an air flow to facilitate detachment of the layers of fibers from said permeable, areas.

7. A machine according to claim 1, wherein said second means transfers the layers of fibers from the cylinder directly onto the surface of the conveyor belt.

8. A machine according to claim 1, wherein the conveyor belt carries a layer of fibers and said second means transfers the layers of fibers on the cylinder onto said layer of fibers on the belt.

9. A machine according to claim 1, wherein said first means comprises means defining a pressure chamber inside said cylinder for generating an air flow to facilitate detachment of the layers of fibers from said permeable areas.

10. In a machine for the manufacture of fiber-containing materials, a rotating cylinder partly immersed in a body of liquid containing fibers in suspension within a tank, the cylinder having a circumferential surface defined by permeable areas and impermeable areas arranged in a predetermined pattern, means for applying a suction to the permeable areas from within the cylinder so that fibers are drawn onto said permeable areas during rotation of the cylinder in the liquid, conveyor belt means adjacent a portion of the cylinder out of contact with the liquid, means enabling transfer of the fibers from said permeable layers to the conveyor belt means, and means for washing the impermeable areas of the cylinder surface upstream of said portion of the cylinder by feeding water across an overflow edge into a space adjacent the cylinder whereby to remove fibers from said impermeable areas by flowing water parallel thereto.

* * * * *